US009472894B2

(12) United States Patent
Jordan

(10) Patent No.: US 9,472,894 B2
(45) Date of Patent: Oct. 18, 2016

(54) ELECTRICAL CONNECTOR FOR MOUNTING TO FLEXIBLE SUBSTRATE AND COUPLING WITH MATING CONNECTOR

(71) Applicant: ITT Manufacturing Enterprises LLC, Wilmington, DE (US)

(72) Inventor: Peter Jordan, Basingstoke (GB)

(73) Assignee: ITT MANUFACTURING ENTERPRISES LLC, Wilmington, DE (US)

( * ) Notice: Subject to any disclaimer, the term of this patent is extended or adjusted under 35 U.S.C. 154(b) by 0 days.

(21) Appl. No.: 14/876,491

(22) Filed: Oct. 6, 2015

(65) Prior Publication Data

US 2016/0099518 A1 Apr. 7, 2016

(30) Foreign Application Priority Data

Oct. 7, 2014 (GB) ..... 1417724.0

(51) Int. Cl.

| | |
|---|---|
| ***H01R 33/00*** | (2006.01) |
| ***H01R 13/629*** | (2006.01) |
| ***H01R 13/74*** | (2006.01) |
| ***H01R 12/77*** | (2011.01) |

(52) U.S. Cl.

CPC ..... *H01R 13/629* (2013.01); *H01R 12/777* (2013.01); *H01R 13/74* (2013.01)

(58) Field of Classification Search

CPC ..... H01R 4/58; H01R 4/64
USPC ..... 439/37, 374, 680, 923
See application file for complete search history.

(56) References Cited

U.S. PATENT DOCUMENTS

| | | | |
|---|---|---|---|
| 1,583,087 | A | 5/1926 | Morse |
| 2,000,318 | A | 5/1935 | Cannon |
| 2,374,971 | A | 5/1945 | Benander |
| 2,677,811 | A | 5/1954 | Anderson et al. |
| 2,761,111 | A | 8/1956 | Klostermann |

(Continued)

FOREIGN PATENT DOCUMENTS

| | | | |
|---|---|---|---|
| DE | 4210491 | A1 | 10/1993 |
| DE | 102006006845 | B3 | 7/2007 |

(Continued)

OTHER PUBLICATIONS

Search Report in corresponding United Kingdom Patent Application No. GB 1417724.0, dated Mar. 27, 2015, in 3 pages.

(Continued)

*Primary Examiner* — Phuong Dinh
(74) *Attorney, Agent, or Firm* — Knobbe, Martens, Olson & Bear LLP

(57) ABSTRACT

An electrical connector for mounting to a flexible substrate and for coupling with a mating connector having a low-profile. The connector comprises a cover portion arranged to extend in a plane parallel to the substrate so as to cover a mounting hole in the substrate. The connector further comprises a body portion comprising a connection port projecting from the cover portion, the connection port having electrical contacts within an end face of the port. The body portion further comprising an alignment collar arranged circumferentially around the connection port, the alignment collar being provided with an alignment feature at a discrete circumferential position for angularly aligning the mating connector with respect to the connection port.

14 Claims, 8 Drawing Sheets

(56) References Cited

U.S. PATENT DOCUMENTS

| | | | | |
|---|---|---|---|---|
| 2,916,720 | A | 12/1959 | Steans | |
| 2,933,711 | A | 4/1960 | Eaton | |
| 3,237,147 | A | 2/1966 | Elliott et al. | |
| 3,352,576 | A | 11/1967 | Thorne-Thomson | |
| 3,747,048 | A | 7/1973 | Johnson et al. | |
| 3,768,065 | A | 10/1973 | Zemels | |
| 3,848,949 | A | 11/1974 | Falkner | |
| 3,962,692 | A | 6/1976 | Murphy et al. | |
| 3,995,930 | A | 12/1976 | Herrmann, Jr. | |
| 4,186,983 | A | 2/1980 | Kaye | |
| 4,364,624 | A | 12/1982 | Williams | |
| 4,708,663 | A | 11/1987 | Eckart | |
| 4,711,510 | A | 12/1987 | Orlando, Jr. | |
| 4,929,188 | A | 5/1990 | Lionetto et al. | |
| 5,195,904 | A | 3/1993 | Cyvoct | |
| 5,288,242 | A | 2/1994 | Muzslay | |
| 5,743,754 | A | 4/1998 | Cristich | |
| 5,911,595 | A | 6/1999 | Orr et al. | |
| 5,938,465 | A | 8/1999 | Fox, Sr. | |
| 6,224,421 | B1 | 5/2001 | Maturo, Jr. | |
| 6,332,815 | B1 | 12/2001 | Bruce | |
| 6,709,289 | B2 | 3/2004 | Huber et al. | |
| 6,966,781 | B1 | 11/2005 | Bullinger et al. | |
| 7,224,582 | B1 * | 5/2007 | Saturley | G06F 1/20 361/679.54 |
| 7,274,964 | B2 | 9/2007 | Balsells | |
| 7,597,588 | B1 | 10/2009 | Hyzin et al. | |
| 7,632,121 | B2 | 12/2009 | Gonzales et al. | |
| 8,100,707 | B2 | 1/2012 | Kussel et al. | |
| 8,375,543 | B1 | 2/2013 | Balsells | |
| 8,496,494 | B2 * | 7/2013 | Jordan | H01R 9/032 439/349 |
| 2006/0046578 | A1 | 3/2006 | Karadimas et al. | |
| 2007/0026695 | A1 | 2/2007 | Lee et al. | |
| 2007/0190868 | A1 | 8/2007 | Cloet et al. | |
| 2008/0166912 | A1 | 7/2008 | Siebens et al. | |
| 2009/0098758 | A1 * | 4/2009 | Bouchan | H01R 13/6273 439/352 |
| 2009/0149036 | A1 * | 6/2009 | Lee | H01R 12/592 439/37 |
| 2010/0100997 | A1 | 4/2010 | Lee et al. | |
| 2011/0207360 | A1 | 8/2011 | Jordan | |
| 2014/0199896 | A1 | 7/2014 | Jordan | |
| 2014/0335739 | A1 * | 11/2014 | Sato | H01R 13/6456 439/680 |

FOREIGN PATENT DOCUMENTS

| | | | |
|---|---|---|---|
| EP | 0050575 | A1 | 4/1982 |
| EP | 0579551 | A1 | 1/1994 |
| EP | 1819019 | A1 | 8/2007 |
| EP | 2362492 | A1 | 8/2011 |
| GB | 2083296 | A | 3/1982 |
| GB | 2477987 | A | 8/2011 |
| GB | 2509924 | A | 7/2014 |
| NL | 8802529 | A | 5/1990 |
| WO | WO 01/15286 | A1 | 3/2001 |

OTHER PUBLICATIONS

Search Report in European Patent Application No. 13195644.3, dated Mar. 18, 2014, in 8 pages.

Search Report in European Patent Application No. 13195644.3, dated Jul. 6, 2015, in 6 pages.

Search Report in United Kingdom Patent Application No. GB 1300845.3, dated Jul. 9, 2013, in 4 pages.

* cited by examiner

ELECTRICAL CONNECTOR FOR MOUNTING TO FLEXIBLE SUBSTRATE AND COUPLING WITH MATING CONNECTOR

FIELD

This disclosure relates to an electrical connector. In particular, the disclosure relates to an electrical connector for mounting to a flexible substrate. The electrical connector of the disclosure is particularly suitable for mating with low profile cable connectors, for which manual disengagement can conventionally be awkward.

The disclosure also relates to an item of clothing or wearable body armour comprising the connector and a connector arrangement comprising the connector and a mating connector.

BACKGROUND

Breakaway electrical connectors for terminating an electrical cable are known, for example from U.S. Pat. No. 2,761,111. Such a connector is arranged to be mechanically engagable with a mating electrical connector mounted in a panel or some other substrate, so as to provide an electrically conductive path between the connectors. The connectors can be firmly engaged but quickly disengaged without excessive manual effort, when required.

GB 2 477 987 A discloses a breakaway electrical connector in the form of a low profile, angled connector. The connector comprises a body having an engagement portion including a sleeve which extends in a longitudinal first direction for engaging with the mating electrical connector, the body further having an opening for routing conductors of the cable away from the connector in a second direction substantially perpendicular to the first direction. At least one resilient member is arranged on the sleeve of the engagement portion, the resilient member being capable of deforming transversely to the first direction and providing a reaction force for maintaining the engagement of the connector with the mating connector. The resilient member comprises a coil spring extending about the sleeve of the engagement portion, the coils of the coil spring having a canted arrangement.

The resilient coil spring of the breakaway connector disclosed in GB 2 477 987 A helps to prevent accidental disengagement of the connectors. The problem of accidental disengagement of the connectors is also addressed in GB 2 509 924 A, which discloses a so-called "straight-pull" connector arrangement in which the connectors can only be disengaged when they are pulled apart in directions that are substantially parallel to the axis of the engagement sleeve.

A further problem has now arisen, in that measures aimed at preventing accidental disengagement of breakaway electrical connectors, including those described above, have made it more difficult to intentionally disengage the connectors. This problem can be exacerbated when the cable connector is a low profile connector, and therefore difficult to manually grip, and/or when the other connector is mounted to a flexible substrate, such as the fabric of an item of clothing. Problems can also arise when the user does not have sight of the connectors, for example when outdoors at night.

In this context, there is a need for a connector design for use with flexible substrates which allows for the risk of accidental disengagement to be minimised while at the same time providing for easier deliberate disengagement.

SUMMARY

According to the disclosure, there are provided connectors, an item of clothing or wearable body armour, and connector arrangements as defined in the claims. According to a first aspect, there is provided an electrical connector for mounting to a flexible substrate and for coupling with a mating connector having a low-profile, the electrical connector comprising:

a cover portion arranged to extend in a plane parallel to the flexible substrate so as to cover a mounting hole in the substrate, the cover portion having an access hole for alignment with the mounting hole;

a backing portion arranged to extend in another plane parallel to the flexible substrate behind the cover portion, such that the substrate is sandwiched between the cover portion and the backing portion, and a body portion integrated with the backing portion and projecting through the mounting hole in the substrate and the access hole in the cover portion, the body portion comprising a connection port having electrical contacts within an end face of the port, the body portion further comprising an alignment collar arranged circumferentially around the connection port, the alignment collar being provided with an alignment feature at a discrete circumferential position for angularly aligning the mating connector with respect to the connection port, wherein the body portion is surrounded by the cover portion, and wherein an outer periphery of the cover portion is cut away at diametrically opposite positions with respect to the connection port to thereby allow improved access and/or flexing of the flexible substrate in said positions when disengaging the mating connector.

The cut away parts of the cover portion, which may be concavely-shaped, provide suitable "guides" into which a user can place their thumb and index finger when disengaging the mating connector, even when the user does not have sight of the connectors. By doing so, the thumb and finger are brought into optimal positions for gripping the mating connector.

Furthermore, it has been found that the cut away parts of the cover portion allow, in a synergistic manner, a flexible substrate in which the connector is mounted to flex, which provides for better and more reliable access to the mating connector by the user's thumb and finger. A simple pinch grip can then be used on the mating connector to disengage the connectors, with the thumb and finger simultaneously bearing against the flexible substrate to push the mating connector away.

As used herein, the term "low-profile" in relation to a connector means that, in its mated condition, the connector has an exposed portion that is not deep enough to be easily gripped by multiple fingers. The term "low-profile" may therefore refer to connectors which, when mated, have an exposed portion for manual gripping that is less than 30 mm deep.

In embodiments, one of the cover portion and the backing portion my further comprise one or more locating studs received by respective locating recesses formed in the other of the cover portion and the backing portion. In this way, the cover portion can be accurately aligned with respect to the backing portion.

In general, the outer periphery of the cover portion may be provided with an upstanding rib extending along the outer periphery. The rib may serve to strengthen the cover portion, as well as enhance the guiding function for the user's thumb and finger.

An outer side wall of the rib may define an angle of greater than 110 degrees, and preferably greater than 120 degrees, with respect to the surrounding flexible substrate at said diametrically opposite positions at which the outer periphery is cut away. The outer side wall of the rib may define an angle of less than 110 degrees, preferably less than 100 degrees, with respect to the surrounding flexible substrate elsewhere. In this way, the side wall at the cut away positions are sloped and may assist the thumb and finger in pushing a mating connector away from the cover portion, in particular by providing a ramped surface which may be used to produce a mechanical advantage.

In embodiments, the outer periphery of the cover portion may have concavely arcuate portions at said diametrically opposite positions at which the outer periphery is cut away. Arcuate portions have been found to be suitable for guiding the thumb and finger while simultaneously facilitating easier deliberate disengagement of the connectors.

In embodiments, the outer periphery of the cover portion is closest to the connecting port and alignment collar at said diametrically opposite positions at which the outer periphery is cut away. Specific embodiments have an outer periphery of the cover portion which is bow-tie or hourglass shaped.

In embodiments, the connection port has side walls comprising a cylindrical portion, such that the connector and the mating connector can only be disengaged by pulling apart in directions substantially parallel to the side walls, that is to say they are so-called "straight-pull" connectors.

Another aspect of the disclosure provides an item of clothing or wearable body armour made from a flexible substrate material, such as a woven, non-woven or knitted fabric, wherein the item comprises the connector described above mounted to the flexible substrate material.

Another aspect provides a connector arrangement comprising a first electrical connector as described above and a second, preferably low profile, electrical connector for mating with the first electrical connector, the second connector comprising:

a body portion comprising an engagement sleeve for engaging with the first electrical connector, the engagement sleeve having electrical contacts for contacting the electrical contacts of the first electrical connector, the body portion further comprising an alignment feature at a discrete circumferential position for engaging with the alignment feature of the first electrical connector to angularly align the connectors; and a cable routing portion having an opening for routing conductors of a terminated cable away from the second connector, wherein the body portion further comprises a circumferential gripping rib arranged to at least partially surround an axis of the engagement sleeve and extending radially outwardly, thereby allowing the connectors in their mated condition to be disengaged by pinching the second connector between the flexible substrate and the circumferential gripping rib with thumb and finger arranged at said diametrically opposite positions at which the outer periphery of the cover portion of the first connector is cut away.

The circumferential gripping rib allows more efficient use to be made of the user's pinch grip. In particular, the thumb and finger can bear not only against the flexible substrate but also the rib to separate the connectors. The circumferential gripping rib of the second connector may extend parallel to the cover portion of the first connector. The circumferential gripping rib may be spaced from the cover portion of the first connector by less than 20 mm, preferably less than 15 mm and more preferably less than 10 mm.

In embodiments, the second electrical connector is an angled electrical connector, with the opening for routing conductors of a terminated cable extending in a routing direction substantially perpendicular to the axis of the engagement sleeve. In the mated condition of the connectors, the routing direction may extend at an angular position that is offset by 90 degrees from each of said diametrically opposite positions at which the outer periphery of the cover portion of the first connector is cut away. In this way, it can be ensured that the cable does not interfere with the user's pinch grip used to disengage the connectors.

In embodiments, the second connector may further comprise a resilient member arranged on the engagement sleeve, and being capable of deforming in a direction radial direction perpendicular to the axis of the engagement sleeve and providing a reaction force for maintaining the engagement between the connectors. The resilient member may be a coil spring extending about the engagement sleeve. The coils of the coil spring may have a canted arrangement, as disclosed in GB 2 477 987 A. The coil spring may be arranged in and retained by a groove or channel formed in the engagement sleeve such that a portion of the coil spring protrudes out of the groove or channel.

BRIEF DESCRIPTION OF THE DRAWINGS

An exemplary embodiment of the disclosure will now be described in detail with reference to the accompanying drawings, in which.

DETAILED DESCRIPTION

The disclosure provides an electrical connector configured to allow a low profile mating connector, such as an angled electrical connector, to be easily disengaged. The connector of the disclosure is particularly suitable for mounting to a flexible substrate, such as the fabric of a wearable garment.

A specific embodiment of the disclosure is based on the applicant's previous connector designs of GB 2 477 987 A and GB 2 509 924 A. The connector design of GB 2 509 924 A will therefore be described, with reference to FIGS. 1 to 4. Further information can be found in GB 2 509 924 A, the entire contents of which are incorporated herein by reference.

Figure 1:
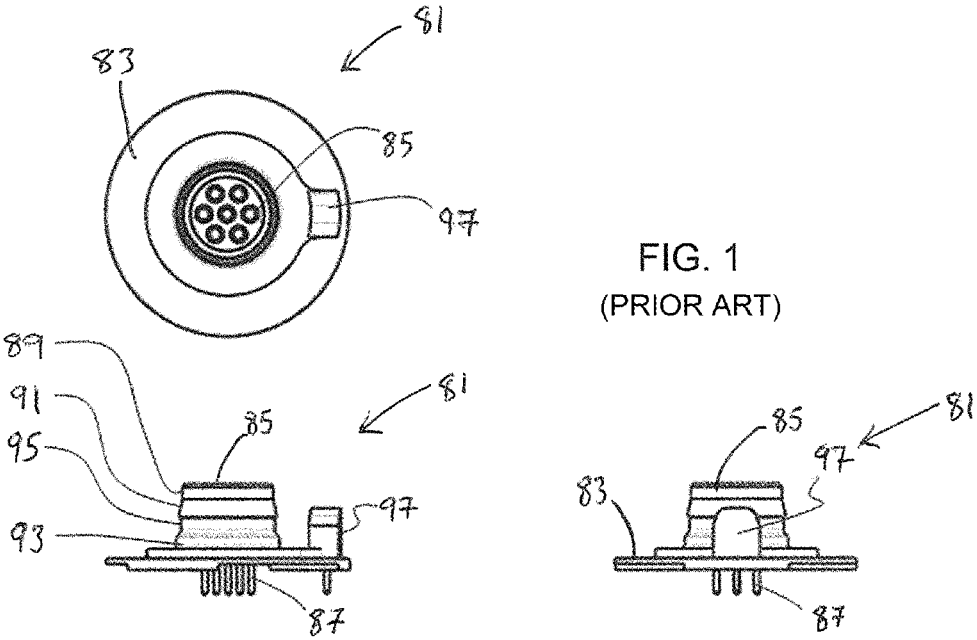
FIG. 1 (PRIOR ART)
FIGS. 1 and 2 provide views of known electrical connectors for receiving an angled electrical connector.
Figure 2:
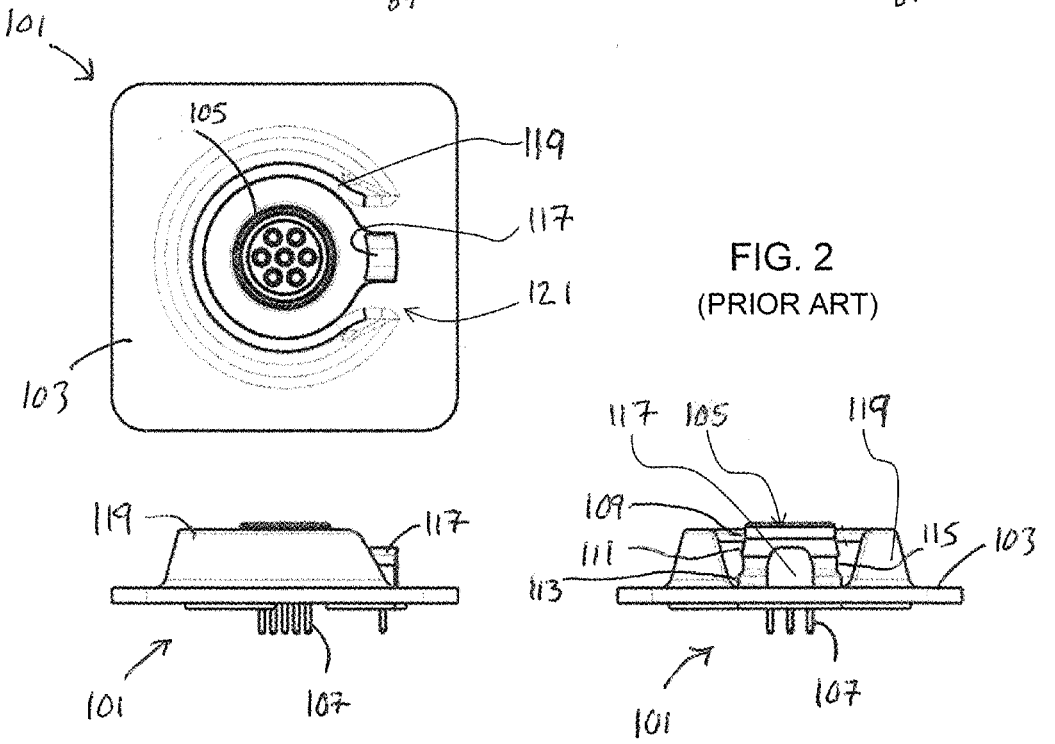
FIG. 2 (PRIOR ART)

FIGS. 1 and 2 are views of known electrical connectors 81, 101 for mounting to a flexible substrate, such as the fabric of a wearable garment.

The connectors 81, 101 each comprise a cover portion 83, 103 arranged to extend in a plane parallel to the flexible substrate so as to cover a mounting hole in the substrate. The connectors 81, 101 also comprise a body portion comprising a connection port 85, 105 which projects from the cover portion 83, 103.

The connection port 85, 105 has electrical contacts within an end face of the port for making electrical connections with the contacts of a mating connector. The electrical contacts extend rearwardly as pins 87, 107 from the connectors 81, 101 for connection to a PCB or similar electrical components behind the substrate to which the connector is mounted.

The connection port 85, 105 has a design which is intended to reduce the risk of an accidental pivoting release of the mating connector. In particular, the projecting connection port 85, 105 has an outer cylindrical portion 89, 109 at or near its end. The cooperation of this cylindrical portion 89, 109 with a corresponding cylindrical portion of a mating connector resists the pivoting release. The connector is accordingly a so-called "straight-pull" connector.

The projecting connection port 85, 105 also has an outer tapered portion 91, 111 so that the end face is smaller than a base of the port. This tapered portion reduces the need for the connector 81, 101 and a mating connector to be perfectly aligned, in a translational sense, during mating. The projecting connection port 85, 105 also has a cylindrical portion 93, 113 at its base and a recessed groove 95, 115 arranged between the base and the tapered section 84 for receiving part of a resilient member of the mating connector when the connectors are mated. The resilient member may be an coil spring, which will be described in more detail below, the coils of which are adapted to bear against the surface of the groove 95, 115 to maintain the mechanical engagement between the mated connectors. The interaction between the groove 95, 115 and the coil spring of the mating connector further reduces the risk of accidental disengagement, since the mated connectors can only be disengaged by deforming the coil spring as it slides out of the groove 95, 115.

To provide angular alignment between the mated connectors, the connector 81, 101 is provided with an orientation key 97, 117, preferably having a large taper. The width of the orientation key 97, 117 at its distal end is for example less than 70% of its width at the widest point. This means that the range of the initial angle of alignment which leads to correct coupling can be increased.

The connector 101 shown in FIG. 2 is additionally provided with a collar 119 surrounding the projecting connection port 85, 105. The collar 119 has a horse shoe shape with an interruption 121 at the location of the orientation key 117. The interruption 121 has a width which enables the mating connector to be mated with the permitted range of misalignment which is tolerated by the tapered orientation key 88. The collar 119 protects the connector 101 from lateral forces and provides additional protection from snagging of the interface. The collar 101 may project to approximately the same height as the projecting connector port 105.

Figure 3:
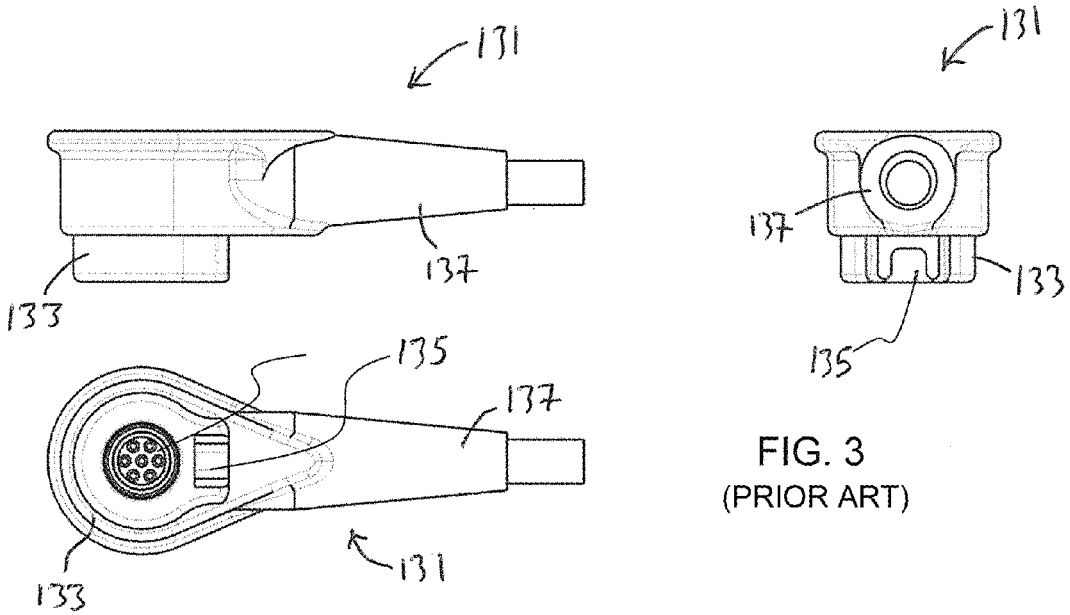
FIG. 3 (PRIOR ART)
FIG. 3 provides views of a known angled electrical connector suitable for connecting to the known electrical connectors shown in FIGS. 1 and 2.

FIG. 3 shows the known mating connector 131 for use with the connector 101 shown in FIG. 2. The mating connector is intended for use in terminating an electrical cable.

The mating connector 131 comprises a body portion which has an engagement sleeve 133 extending in a first longitudinal direction. A plurality of electrical contacts are arranged within the sleeve 133 for making contact with the contacts of the connector 101. The electrical contacts project a shorter distance than the depth of the sleeve so that the projecting sleeve can be easily wiped clean and the contacts are not susceptible to damage.

An orientation key recess 135 is provided for receiving the orientation key 117 of the connector 101, with a tapered surface to match the taper of the orientation key 117.

The mating connector 131 also comprises a cable routing portion 137 extending from the body portion in a second direction which is perpendicular to the first direction. The cable routing portion 137 defines an elongate opening for routing the inner conductors of a terminated cable away from the mating connector 131.

The engagement sleeve 133 of the mating connector 131 is arranged to engage with the projecting connection port 105 of the connector 101. The sleeve 133 is provided with a resilient member in the form of an coil spring (not shown) arranged in and retained by an annular groove formed in the inner surface of the engagement sleeve 133. A portion of each coil of the coil spring protrudes from the annular groove. The coil spring has a canted arrangement whereby the coils of the spring are canted with respect to a centerline of the coil spring. Thus, entire coils of the coil spring each define an acute angle with a respective plane normal to the centreline of the spring. A radial cross section of the canted coil spring has an elliptical shape. The protruding portion of the spring is displaceable in a radially outward direction, thereby compressing the spring and causing increased canting, in response to which a reaction force acts in a radially inward direction.

The groove of the engagement sleeve 133 in which the coil spring is arranged may be defined by a pair of spaced apart first and second flanges which extend inwardly from the sleeve 133. The coil spring is arranged to bear against the connection port 105 of the connector 101 when the connectors 101, 131 are mated. In their mated condition, the coil spring is partially received into the recessed groove 115 of the connection port 115 to thereby maintain the engagement between the connectors.

Figure 4:
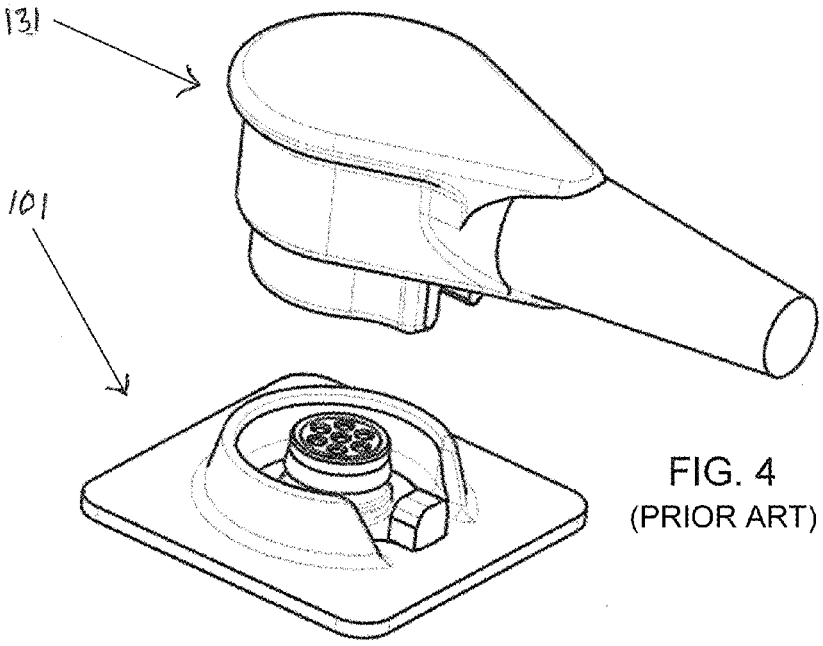
FIG. 4 (PRIOR ART)
FIG. 4 is a view of the known electrical connector and angled electrical connector ready for engagement.

FIG. 4 shows the two connectors 81, 101 being brought into engagement.

Specific embodiments of the present disclosure provides various design changes to the connectors 81, 101 described above and will now be described with reference to FIGS. 5 to 10.

Figure 5:
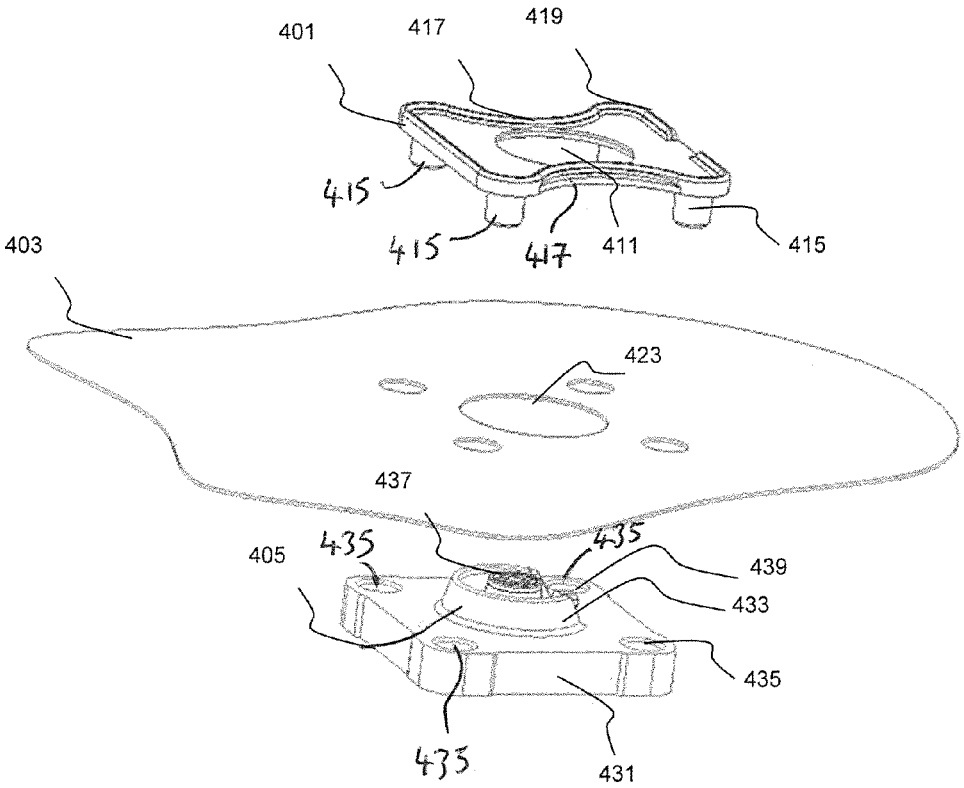
FIG. 5 is an exploded view of an electrical connector according to the disclosure.
Figure 6:
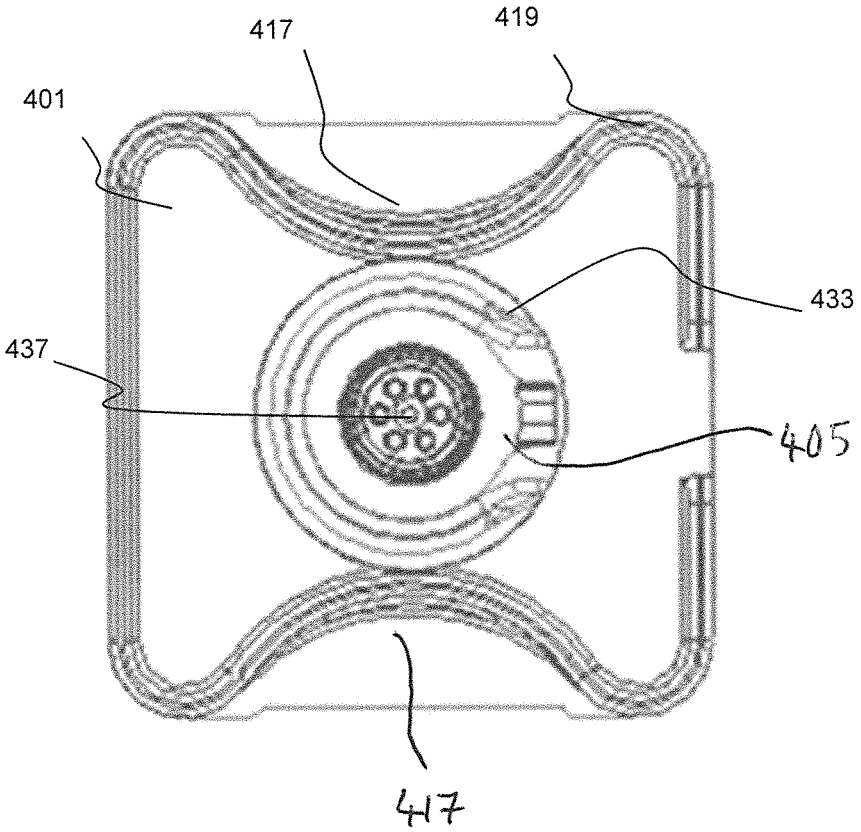
FIG. 6 is a plan view of the assembled electrical connector according to the disclosure.
Figure 7:
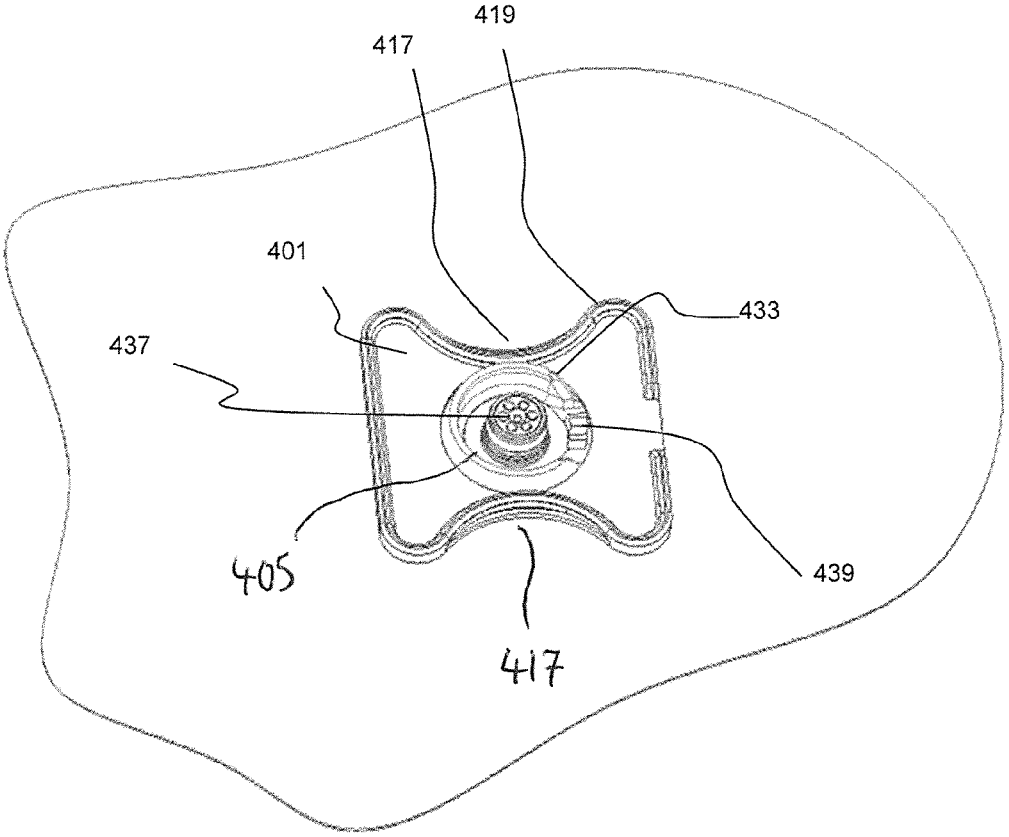
FIG. 7 is a perspective view of the assembled connector arrangement according to the disclosure.

FIGS. 5 to 7 show various views of a connector according to the disclosure for mounting to a flexible substrate 403 and for coupling with a low-profile mating connector (which is not shown in FIGS. 5 to 7). The electrical connector comprises a cover portion 401 arranged to extend in a plane parallel to the substrate 403 so as to cover a mounting hole 423 in the flexible substrate 403.

The electrical connector further comprises a body portion 405 comprising a connection port 437 projecting from the cover portion 401 and an alignment collar 433 arranged circumferentially around the connection port 437. The alignment collar 433 is provided with an alignment feature 439 at a discrete circumferential position for angularly aligning the mating connector with respect to the connection port 437. The alignment feature comprises an interruption in the collar 433 with a tapered alignment projection positioned within the interruption.

The connection port 437 has electrical contacts within an end face of the port. The electrical contacts are assembled to the connector in a conventional manner.

The connection port 437 and alignment collar 433 are surrounded by the cover portion 401, when the connector is assembled, as shown in FIGS. 6 and 7. An outer periphery of the cover portion 401 is cut away 417 at diametrically opposite positions with respect to the connection port 437 to thereby allow flexing of the flexible substrate 403 in said positions when disengaging a mating connector. As such, the cut away parts of the cover portion provide "guides" into which a user can place their thumb and index finger when disengaging the mating connector, even when the user does not have sight of the connectors. Furthermore, by providing the cut away parts 417, the thumb and finger of the user can be brought into optimal positions for gripping the mating connector.

It has also been found that the cut away parts 417 of the cover portion 401 allow the flexible substrate 403 to flex, which provides for better and more reliable access to the mating connector by the user's thumb and finger. A simple pinch grip can then be used on the mating connector to disengage the connectors, with the thumb and finger simultaneously bearing against the flexible substrate 403 to push the mating connector away.

The body portion 405 of the connector is integrated with a backing portion 431 arranged to extend in a plane parallel to the flexible substrate 403 behind the cover portion 401, such that the substrate 403 is sandwiched between the cover portion 401 and the backing portion 431. The connection port 437 and alignment collar 433 project through the mounting hole 423 in the substrate 403 and through an access hole 411 in the cover portion 401. This sandwich structure provides a secure mounting for the connector and effectively conceals the mounting hole 423 in the substrate 403.

The cover portion 401 comprises four locating studs 415 arranged about the connection port 437 and extending rearwardly such that they are received into respective locating recesses 435 formed in the backing portion 431. The studs 415 and recesses 435 provide for accurately alignment of the cover portion 401 with respect to the backing portion 431 and with respect to the substrate 403.

The outer periphery of the cover portion 401 is provided with an upstanding rib 419 extending along the outer periphery. The rib 419 serves to strengthen the cover portion 401, as well as to enhance the guiding function for the user's thumb and finger.

An outer side wall of the rib 419 defines an angle of approximately 120 degrees with respect to the surrounding flexible substrate 403, at said diametrically opposite positions at which the outer periphery is cut away 417. Elsewhere in the outer periphery, the outer side wall of the rib 419 defines an angle of approximately 90 degrees with respect to the surrounding flexible substrate. The resulting sloped side walls in the cut away areas assists the thumb and finger in pushing a mating connector away from the cover portion 401, in particular by providing a ramped surface which may be used to produce a mechanical advantage.

The outer periphery of the cover portion has concavely arcuate portions at said diametrically opposite positions at which the outer periphery is cut away. Such arcuate portions have been found to be particularly suitable for guiding the thumb and finger while simultaneously facilitating easier deliberate disengagement of the connectors. The arcuate portions are shown more clearly in FIG. 6, from which it can be seen that the outer periphery of the cover portion is bow-tie shaped.

As with the connectors shown in FIGS. 1 and 2, the connection port 437 has side walls comprising a cylindrical portion, such that the connector and the mating connector can only be disengaged by pulling apart in directions substantially parallel to the side walls. Thus, the connector is of the so-called "straight-pull" type.

Figure 8:
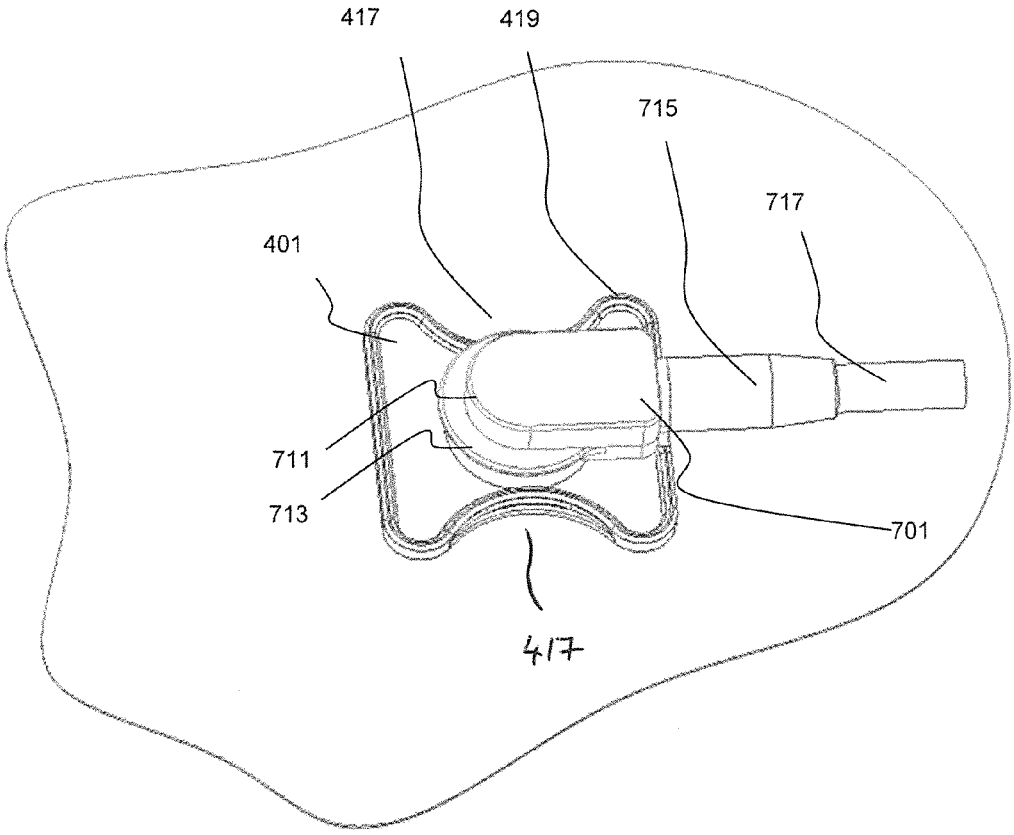
FIG. 8 is a perspective view of a connector arrangement according to the disclosure comprising the electrical connector shown in FIGS. 5 to 7.
Figure 9:
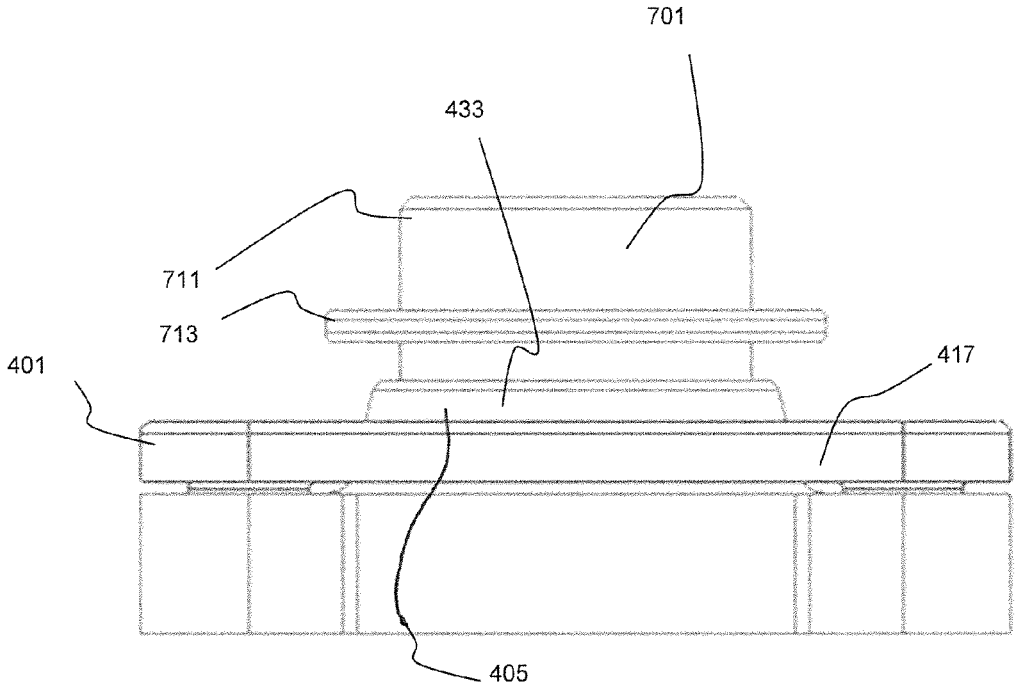
FIG. 9 is an end view of the connector arrangement according to the disclosure.
Figure 10:
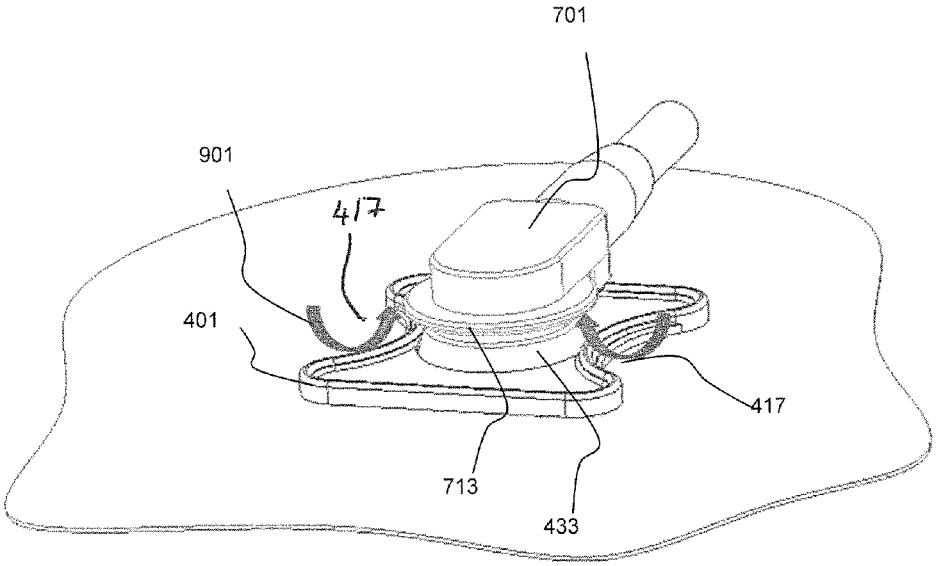
FIG. 10 is a perspective view of the connector arrangement according to the disclosure for explaining how a pinch grip is used to disengage the connectors.

FIGS. 8 to 10 show a connector arrangement comprising a first electrical connector as described above and a second, low-profile, electrical connector 701. The connectors are shown in the mated condition.

The second connector 701 is similar in many ways to the known mating connector 131 shown in FIG. 3. Thus, the connector 701 comprises a body portion 711 comprising an engagement sleeve for engaging with the first electrical connector. The engagement sleeve is provided with electrical contacts in a conventional manner for contacting the electrical contacts of the first electrical connector.

The body portion 711 further comprises an alignment recess at a discrete circumferential position for engaging with the alignment feature 439 of the first electrical connector, to thereby angularly align the connectors.

The second connector 701 further comprises a cable routing portion 715 having an opening for routing conductors of a terminated cable 717 away from the second connector. The second electrical connector 701 is an angled electrical connector, with the opening for routing conductors of a terminated cable therefore extending in a routing direction substantially perpendicular to the axis of the engagement sleeve.

In the mated condition of the connectors, the routing direction extends at an angular position that is offset by 90 degrees from each of said diametrically opposite positions at which the outer periphery of the cover portion of the first connector is cut away, as illustrated in FIG. 8. In this way, it can be ensured that the cable does not interfere with the user's pinch grip used to disengage the connectors.

The body portion 711 further comprises a circumferential gripping rib 713 arranged to at least partially surround an axis of the engagement sleeve and extending radially outwardly. The rib 713 allows the connectors in their mated condition to be disengaged by pinching the second connector 701 between the flexible substrate and the circumferential gripping rib with thumb and finger arranged at said diametrically opposite positions at which the outer periphery of the cover portion 401 of the first connector is cut away 417.

The circumferential gripping rib 713 of the second connector extends parallel to the cover portion 401 of the first connector and is spaced from the cover portion 401 of the first connector by approximately 8 mm.

The circumferential gripping rib 713 allows more efficient use to be made of the user's pinch grip, such as shown by the arrows 901 in FIG. 10. In particular, the thumb and finger can bear not only against the flexible substrate 703 but also the lower surface of the rib 713 to separate the connectors.

The engagement sleeve of the second connector is similar to the engagement sleeve of the mating connector 131 shown in FIG. 3. In particular, a resilient member in the form of a canted coil spring is arranged on the engagement sleeve, and is capable of deforming in a radial direction perpendicular to the axis of the engagement sleeve to provide a reaction force for maintaining the engagement between the connectors. The coil spring is arranged in and retained by a groove or channel formed in the engagement sleeve, such that a portion of the coil spring protrudes out of the groove or channel for engagement with the connection port 437 of the first connector.

Specific embodiments of the invention have been described above. It will be apparent that various modifications may be made without departing from the invention.

For example, in the embodiments described above, the alignment collar of the electrical connector is physically distinct (i.e. spaced) from the connection port and has a height which is similar to that of the connection port. However, in alternative embodiments the alignment collar need not extend to the same height as the connection port. Moreover, the alignment collar may be integrated with other portions of the connector, including the connection port. The alignment collar could, for example, be integrated into the cylindrical side wall of the connection port.

The invention claimed is:

1. An electrical connector for mounting to a flexible substrate and for coupling with a mating connector having a low-profile, the electrical connector comprising:

a cover portion arranged to extend in a plane parallel to the flexible substrate so as to cover a mounting hole in the substrate, the cover portion having an access hole for alignment with the mounting hole;

a backing portion arranged to extend in another plane parallel to the flexible substrate behind the cover portion, such that the substrate is sandwiched between the cover portion and the backing portion, and a body portion integrated with the backing portion and projecting through the mounting hole in the substrate and the access hole in the cover portion, the body portion comprising a connection port having electrical contacts within an end face of the port, the body portion further comprising an alignment collar arranged circumferentially around the connection port, the alignment collar being provided with an alignment feature at a discrete circumferential position for angularly aligning the mating connector with respect to the connection port, wherein the body portion is surrounded by the cover portion, and wherein an outer periphery of the cover portion is cut away at diametrically opposite positions with respect to the connection port to thereby allow improved access and/or flexing of the flexible substrate in said positions when disengaging the mating connector.

2. The connector as claimed in claim 1, wherein one of the cover portion and the backing portion further comprises one or more locating studs received by respective locating recesses formed in the other of the cover portion and the backing portion, so as to angularly align the cover portion with respect to the backing portion.

3. The connector as claimed in claim 1, wherein the outer periphery of the cover portion is provided with an upstanding rib extending along the outer periphery.

4. The connector as claimed in claim 3, wherein an outer side wall of the rib defines an angle of greater than 110 degrees, and preferably greater than 120 degrees, with respect to the surrounding flexible substrate at said diametrically opposite positions at which the outer periphery is cut away, and wherein the outer side wall of the rib defines an angle of less than 110 degrees, preferably less than 100 degrees, with respect to the surrounding flexible substrate elsewhere.

5. The connector as claimed in claim 1, wherein the alignment feature of the alignment collar is arranged at an angular position that is offset by 90 degrees from each of said diametrically opposite positions at which the outer periphery of the cover portion is cut away.

6. The connector as claimed in claim 1, wherein the alignment feature of the alignment collar comprises an interruption in the collar, and optionally further comprises a tapered alignment projection positioned within the interruption.

7. The connector as claimed in claim 1, wherein the outer periphery of the cover portion has arcuate portions at said diametrically opposite positions at which the outer periphery is cut away.

8. The connector as claimed in claim 1, wherein the outer periphery of the cover portion is closest to the connecting port at said diametrically opposite positions at which the outer periphery is cut away, and optionally wherein the outer periphery of the cover portion has a bow-tie or hourglass shape.

9. The connector as claimed in claim 1, wherein the connection port has side walls comprising a cylindrical portion, such that the connector and the mating connector can only be disengaged by pulling apart in directions substantially parallel to the side walls.

10. An item of clothing or wearable body armour made from a flexible substrate material, such as a woven, non-woven or knitted fabric, wherein the item comprises the connector as claimed in claim 1 mounted to the flexible substrate material.

11. A connector arrangement, comprising a first electrical connector as claimed in claim 1 and a second, low profile electrical connector for mating with the first electrical connector, the second connector comprising:

a body portion comprising an engagement sleeve for engaging with the first electrical connector, the engagement sleeve having electrical contacts for contacting the electrical contacts of the first electrical connector, the body portion further comprising an alignment feature at a discrete circumferential position for engaging with the alignment feature of the first electrical connector to angularly align the connectors; and a cable routing portion having an opening for routing conductors of a terminated cable away from the second connector, wherein the body portion further comprises a circumferential gripping rib arranged to at least partially surround an axis of the engagement sleeve and extending radially outwardly, thereby allowing the connectors in their mated condition to be disengaged by pinching the second connector between the flexible substrate and the circumferential gripping rib with thumb and finger arranged at said diametrically opposite positions at which the outer periphery of the cover portion of the first connector is cut away.

12. The connector arrangement of claim 11, wherein the second electrical connector is an angled electrical connector, the opening for routing conductors of a terminated cable extending in a routing direction substantially perpendicular to the axis of the engagement sleeve, and optionally wherein, in the mated condition, the routing direction extends at an angular position that is offset by 90 degrees from each of said diametrically opposite positions at which the outer periphery of the cover portion of the first connector is cut away.

13. The connector arrangement of claim 11, wherein, in the mated condition, the circumferential gripping rib of the second connector extends parallel to the cover portion of the first connector, and wherein the circumferential gripping rib is spaced from the cover portion by less than 20 mm, preferably less than 15 mm and more preferably less than 10 mm.

14. The connector arrangement of claim 11, wherein the second connector further comprises a resilient member arranged on the engagement sleeve and being capable of deforming in a direction radial direction perpendicular to the axis of the engagement sleeve and providing a reaction force for maintaining the engagement between the connectors, optionally wherein the resilient member is a coil spring extending about the engagement sleeve, and further optionally wherein the coils of the coil spring have a canted arrangement.

* * * * *